US005314256A

United States Patent [19]

Niwa

[11] Patent Number: 5,314,256

[45] Date of Patent: May 24, 1994

[54] PRINTING DEVICE

[75] Inventor: Akihiko Niwa, Toki, Japan

[73] Assignee: Brother Kogyo Kabushiki Kaisha, Aichi, Japan

[21] Appl. No.: 949,772

[22] Filed: Sep. 22, 1992

[30] Foreign Application Priority Data

Sep. 25, 1991 [JP] Japan ..... 3-274852

[51] Int. Cl.[5] ..... B41J 5/30

[52] U.S. Cl. ..... 400/61; 395/110; 400/76; 345/143

[58] Field of Search ..... 400/61, 63, 67, 68, 400/76, 70, 74; 340/723, 731, 735; 395/102, 108, 110, 115, 116, 117

[56] References Cited

U.S. PATENT DOCUMENTS

| | | | |
|---|---|---|---|
| 4,655,622 | 4/1987 | Aoki | 400/61 |
| 4,660,999 | 4/1987 | Tsuneki | 400/61 |
| 4,671,683 | 6/1987 | Ueno et al. | 400/61 |
| 4,718,784 | 1/1988 | Drisko | 400/68 |
| 4,741,635 | 5/1988 | Shibata et al. | 400/61 |
| 4,755,955 | 7/1988 | Kimura et al. | 400/63 |
| 4,763,281 | 8/1988 | Arakawa | 340/735 |
| 4,799,172 | 1/1989 | Wood et al. . | |
| 4,814,892 | 3/1989 | Igarashi | 400/74 |
| 4,826,332 | 5/1989 | Ukai et al. | 400/70 |
| 4,832,513 | 5/1989 | Ikekita | 400/76 |
| 4,849,747 | 7/1989 | Ogawa et al. | 340/735 |
| 4,875,174 | 10/1989 | Olodort et al. | 400/63 |
| 4,924,324 | 5/1990 | Takaoka . | |
| 4,933,866 | 6/1990 | Markoff et al. | 340/735 |
| 4,988,221 | 1/1991 | Shibayama et al. | 400/76 |
| 5,033,880 | 7/1991 | Kageyama et al. | 400/76 |
| 5,066,152 | 11/1991 | Kuzuya et al. | 400/621 |
| 5,119,471 | 6/1992 | Kagaya et al. | 395/110 |
| 5,123,758 | 6/1992 | Uematsu | 400/63 |

OTHER PUBLICATIONS

Patent Abstracts of Japan vol. 15, No. 162 (P-1194) Apr. 23, 1991 & JP-A-30 30 049 (Toshiba Corp.) Feb. 8, 1991.

Patent Abstracts of Japan vol. 12, No. 371 (M-748) Oct. 5, 1988 & JP-A-63 122 568 (Canon Inc.) May 26, 1988.

U.S. Ser. No. 07/831,971 filed on Feb. 6, 1992.

*Primary Examiner*—Eugene H. Eickholt

*Attorney, Agent, or Firm*—Kane, Dalsimer, Sullivan, Levy, Eisele and Richard

[57] ABSTRACT

A printing device capable of printing a plurality of characters/symbols in a plurality of lines on a tape. The device determines the size of the characters/symbols to be printed on the tape based upon the number of lines to be printed and upon the number of characters/symbols to be printed within a predetermined area.

22 Claims, 9 Drawing Sheets

FIG. 4

19

| CHARACTER SIZE | LONGITUDINAL DOTS | LATERAL DOTS |
|---|---|---|
| S1 (MAX.) | T1d | Y1d |
| S2 | T2d | Y2d |
| S3 | T3d | Y3d |
| S4 | T4d | Y4d |
| S5 | T5d | Y5d |
| S6 | T6d | Y6d |
| S7 | T7d | Y7d |
| S8 | T8d | Y8d |
| — | — | — |
| — | — | — |
| — | — | — |
| — | — | — |
| — | — | — |
| — | — | — |
| Si (MIN.) | Tid | Yid |
| | Er | Er |

Tp

Tp Yp

PRINTING DEVICE

BACKGROUND OF THE INVENTION

The present invention relates to a printing device for printing images, such as characters/symbols on a tape.

Conventionally, there are various proposals for a printing device for printing desired character trains onto a tape as a recording medium having a width of about 10 mm. The present assignee proposed in U.S. Pat. No. 5,066,152 that a printing device by which desired characters and symbols are selectively inputted while a character selection dial is rotated, these input characters and the like are printed onto a tape with use of a thermal head in response to the operation of print keys and the tape on which the characters and the like have been printed is adhered to a desired location of a file or the like.

Further, the present assignee proposed in the U.S. patent application Ser. No. 07/831,971 a printing device by which the print region on print tape having a width of about 10 mm is divided into two portions along a tape width direction to provide two print lines, and input characters are printed on a desired print line by using a dot pattern having a small character size of printing characters to the two print lines.

Incidentally, it can be contemplated to prepare many kinds of print tapes having widths of, for example, 12 mm, 18 mm . . . 24 mm so that these tapes can be adhered to many kinds of portions of a file, notebook and the like. Further, it can be also contemplated to print characters on many lines such as 3, 4 or 5 lines.

However, the printing device proposed by the present assignee in Japanese Patent Application HEI 3-91492 is arranged to print characters to 1 or 2lines by using a relatively narrow print tape having a tape width of about 10 mm. In this case, even if a plurality of kinds of dot pattern data for characters and symbols can be provided in correspondence with a plurality of kinds of character sizes, the size of characters to be printed is roughly aimed at and manually set in accordance with a tape width to which the size of characters to be printed is applied and the number of lines of the characters to be printed. The character size is not optimized in many cases. Thus, a problem arises in that an operation for setting an optimum character size based on a tape width and the number of lines is made complex.

SUMMARY OF THE INVENTION

It is therefore an object of the present invention to provide an improved printing device capable of automatically determining the optimum size of characters to be printed in accordance with the print conditions of the width of a tape used as a print medium and the number of lines of inputted characters.

For the above object, according to the present invention, there is provided a printing device for printing characters/symbols on a tape member having a predetermined width, comprising means for inputting a length of the tape member within which the characters/symbols are printed, first detecting means for detecting the number of the characters/symbols to be printed in a line within the length of the tape member, second detecting means for detecting the number of lines to be printed within the predetermined width;

means for determining the size of the characters/symbols to be printed based upon the number of the characters/symbols detected by the first detecting means; and the number or lines detected by the second detecting means.

Optionally, the determining means determines the size of the characters/symbols to be printed in such a fashion that the determining means determines a first size based upon the number of the characters/symbols, and a second size based upon the number of lines of the characters/symbols, and thereafter the determining means selecting a smaller one of the first and second sizes as the size of the characters/symbols to be printed.

Further, the determining means determines the first size in accordance with the dividing operation in which a number of dots capable of being included in a line within the length is divided by the number of the characters/symbols to be printed within the length of the tape member. On the other hand, the determining means determines the second size in accordance with the dividing operation in which the number of dots capable of being included in the predetermined width is divided by the number of lines of the characters/symbols to be printed within the predetermined width.

Furthermore, there is provided a memory for storing dot data corresponding to a plurality of sizes of the characters/symbols, and wherein the determining means selects one of the plurality of sizes as the size of characters/symbols to be printed.

Further optionally, there is provided means for inhibiting printing operation when the size determined by the determining means is smaller than a predetermined size.

According to another aspect of the invention, there is provided a printing device for printing characters/symbols on a tape member, comprising means for detecting the number of the characters/symbols to be printed within a predetermined area, means for determining the size of the characters/symbols to be printed based upon the number of the characters/symbols.

According to further aspect of the invention, there is provided a printing device for printing characters/symbols on a tape member having a predetermined width, comprising means for detecting the number of lines to be printed within, and means for determining the size of the characters/symbols to be printed based upon the number of lines of the characters/symbols.

According to still further aspect of the invention, there is provided a combination of a printer for printing characters/symbols on a tape member and a cassette detachably coupled to the printer for accommodating the tape member therein, wherein the cassette comprises: means for indicating the width of the tape accommodated therein, and wherein the printer comprises: means for detecting the number of lines to be printed; and means for determining the size of the characters/symbols to be printed based upon the number of lines of the characters/symbols.

According to the printing device of the present invention, a character size to be printed is determined in accordance with the tape width of a tape used as a print medium and the number of lines of inputted characters, an optimum character size based on these print conditions can be automatically determined.

DESCRIPTION OF THE ACCOMPANYING DRAWINGS

FIG. 4 is a character table showing a data arrangement composed of character sizes, the number of longitudinal dots and lateral dots;

DESCRIPTION OF THE EMBODIMENTS

Figure 1:
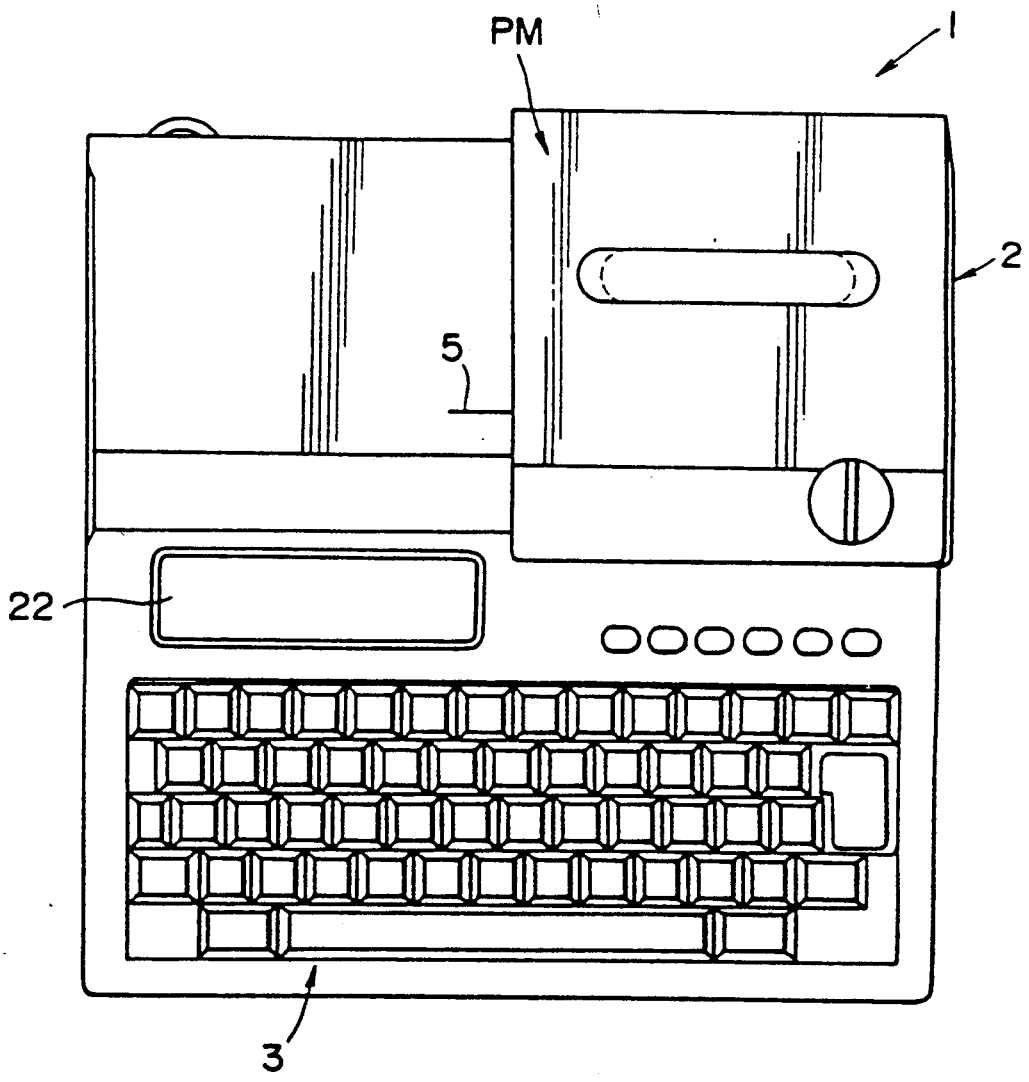
FIG. 1 is a plan view of a printing device embodying the present invention.

FIG. 1 is a plan view of a printing device 1 embodying the present invention. The printing device 1 is capable of printing images such as a number of characters/-symbols and the like on a plurality of lines of a tape, or a tape-form printing medium in the width direction thereof.

As shown in FIG. 1, a keyboard 3 is disposed on the front portion of the main body frame 2 of a printing device 1, a print mechanism PM is disposed in the main body frame 2 behind (upper direction in the figure) the keyboard 3, and further a liquid crystal display unit 22 capable of displaying characters and symbols is disposed behind (upper direction in the figure) the keyboard 3.

The keyboard 3 includes character keys for inputting alphabet, or the like, numeral keys, symbol keys, a return key, non-conversion key, conversion key, print key for performing a print processing, font selection key for selecting a font of characters, tape feed key for feeding the tape 5, power supply key for tuning ON and OFF a power supply, and the like.

Further, the keyboard 3 includes a character size key for setting a character size, a print length key for setting the length of the tape 5 used when characters are printed, a cursor movement key for moving a cursor in the upward and downward directions and in the right and left directions within the display unit 22, and the like.

Next, the print mechanism PM will be simply described with reference to FIGS. 2A and 2B. The print mechanism PM includes a rectangular tape accommodation cassette CS detachably loaded thereto. The tape accommodation cassette CS includes a tape spool 6 around which the tape 5 having a width of about 24 mm and formed of a transparent film is wound; a ribbon supply spool 8 around which an ink ribbon 7 is wound; a winding spool 9 for winding the ink ribbon 7; a supply spool 11 around which a double-sided adhesive tape 10 having the same width as that of the tape 5 is wound with the releasable paper provided facing the outside; and a adhere roller 12 for adhering the print tape 5 with the double-sided adhesive tape 10. These spool and roller are rotatably mounted to the tape accommodation cassette CS.

A thermal head 13 is vertically disposed at the position where the print tape 5 is placed on the ink ribbon 7. A platen roller 14 for pressing the print tape 5 and ink ribbon 7 against the thermal head 13, and a feed roller for pressing the print tape 5 and double-sided adhesive tape 10 against the adhere roller 12 are rotatably supported by a support member 16. The thermal head 13 includes a heating element group composed of 128 heating elements aligned in the width direction of the tape 5 thereon.

Therefore, when the heating element group is energized while the adhere roller 12 and winding spool 9 are driven in a predetermined rotational direction synchronously with each other in accordance with the rotation of a tape feed motor 24 (refer to FIG. 3) in a predetermined rotational direction, characters/symbols are printed onto the tape 5. Moreover, the tape 5 is fed in a tape feed direction A while being adhered with the double-sided adhesive tape 10. With respect to the detail of the print mechanism PM, refer to Japanese Patent Provisional Publication HEI 2-106555.

Figure 2A:
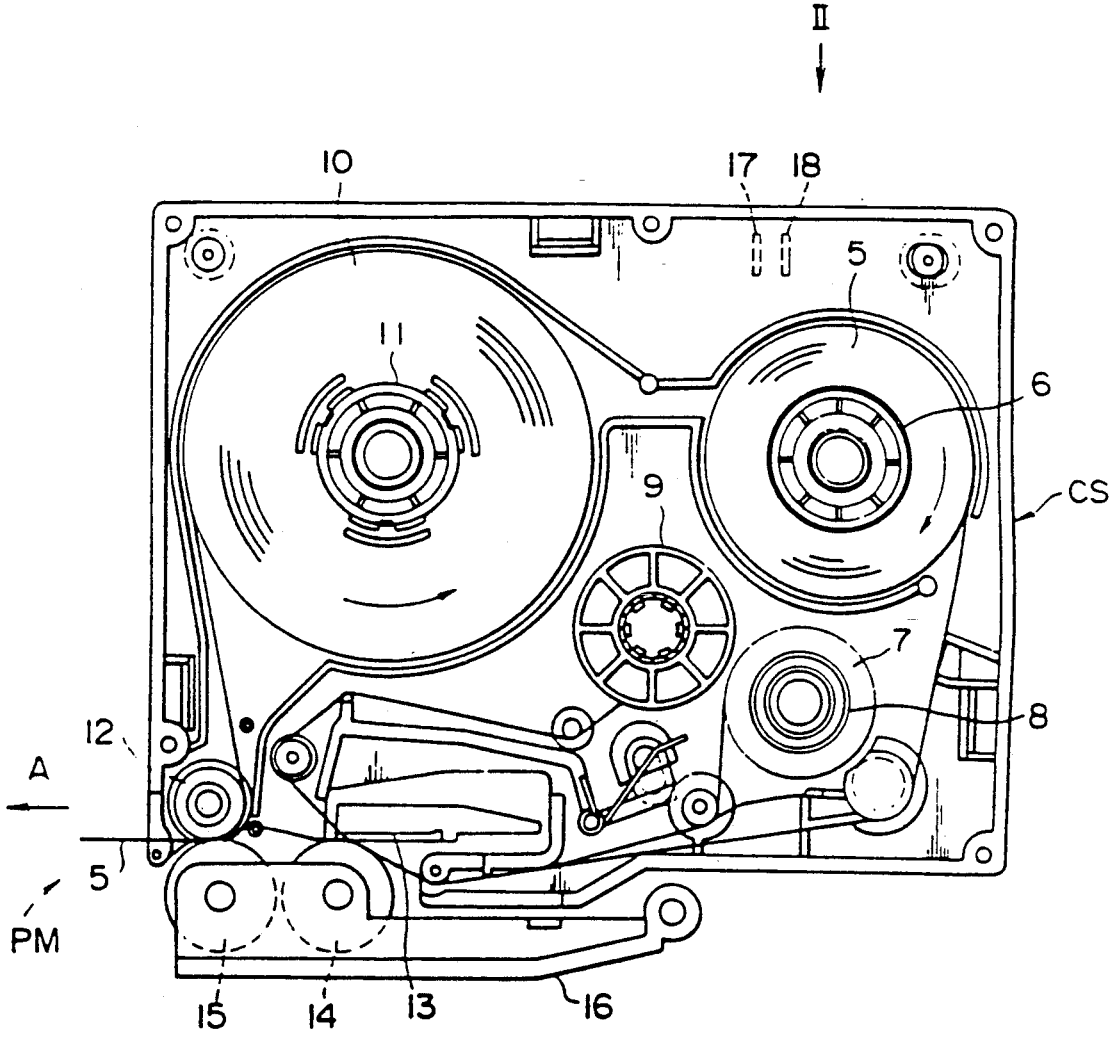
FIG. 2A is a schematic plan view of a print mechanism.
Figure 2B:
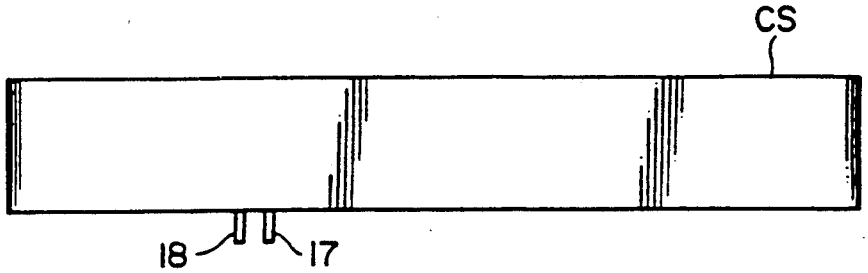
FIG. 2B is a side view of a cassette CS viewed from arrow II in FIG. 2A.

As shown in FIG. 2A, which shows the side view of the accommodation cassette CS viewed from arrow II in FIG. 2A, a pair of projected pieces 17, 18 projecting downwardly are integrally defined at the bottom wall of the tape accommodation cassette CS so that the tape width of the tape 5 accommodated therein can be indicated by the presence or absence of these projected pieces 17, 18. More specifically, when both the projected pieces 17, 18 are provided with the tape accommodation cassette CS shown in FIG. 2, the tape 5 accommodated therein has a width of 24 mm. Although not shown, when only the projected piece 17 is provided on a tape accommodation cassette CS, the tape 5 has a width of 18 mm; when only the projected piece 18 is provided on a tape accommodation cassette SS, the tape 5 has a width of 12 mm; and when none of the projected pieces 17, 18 is provided on a tape accommodation cassette CS, the tape 5 has a width of 6 mm. Corresponding to the projected pieces 17 and 18, first and second sensors 20, 21 composed of a photo interrupter (refer to FIG. 3) are provided in the main body frame 2 to detect the projected pieces 17, 18 when the tape accommodation cassette is loaded.

Figure 3:
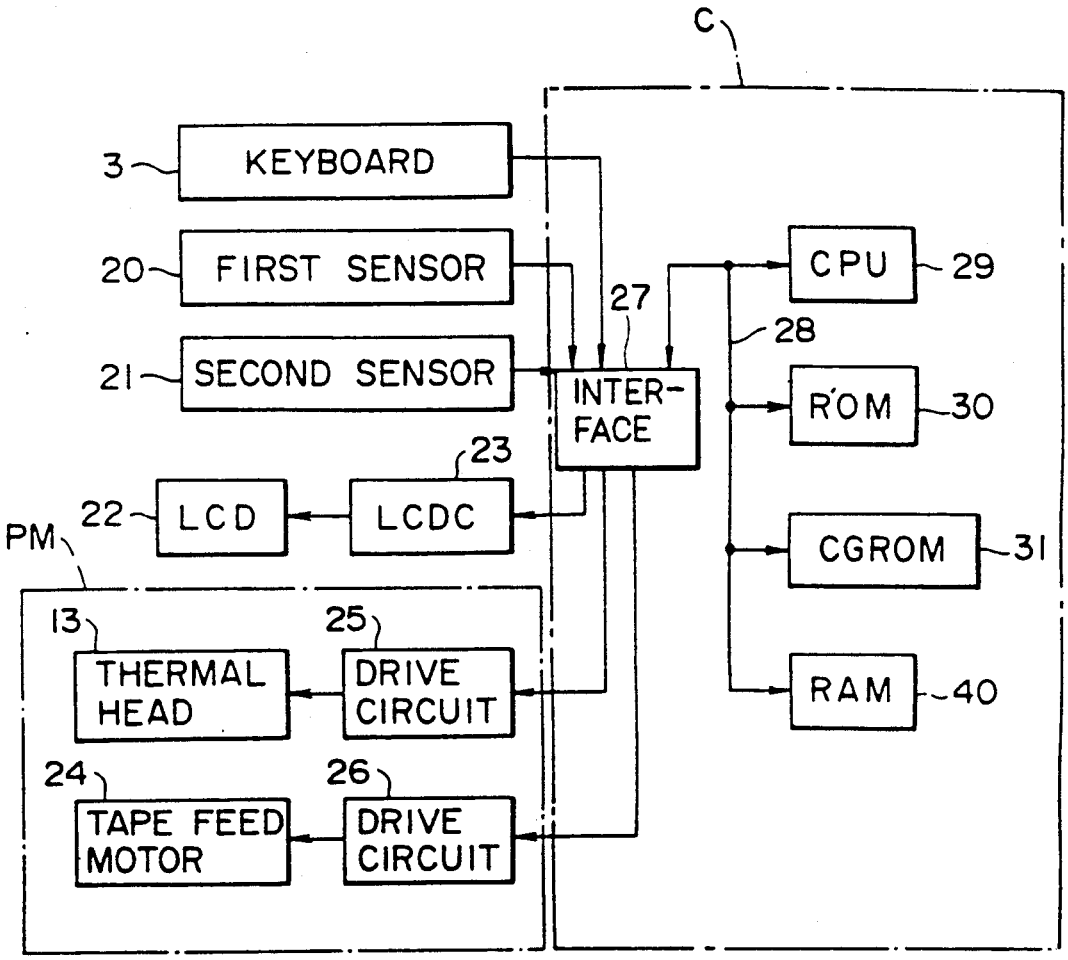
FIG. 3 is a block diagram of the control system of the printing device.

Next, the control system of the printing device 1 is arranged as shown in the block diagram of FIG. 3.

The key board 3, the first sensor 20, the second sensor 21, a liquid crystal display controller (LCDC) 23 having a display RAM for outputting display data to the liquid crystal display unit (LCD) 22, drive circuit 25 for driving the thermal head 13, and drive circuit 26 for driving the tape feed motor 24 are interconnected to the I/O interface 27 of a control unit C, respectively.

The control unit C includes a CPU 29, the I/O interface 27 connected to the CPU 29 through a bus such as a data bus 28, ROM (Read Only Memory) 30, CGROM (Character Generator ROM) 31 and RAM 40.

The ROM (as a program memory) 30 stores:

a display control program for controlling the display controller 23 in correspondence with the code data of characters, numerals, symbols and the like inputted through the keyboard 3;

a control program for storing the code data in a text memory 41;

an image development control program for developing a dot pattern corresponding to each of the code data stored in the text memory 41 to a print buffer 51;

a drive control program for controlling the drive of the thermal head 13 and tape feed motor 24 by sequentially reading data in a print buffer 34;

a control program characteristic to the present application for a tape print control to be described later;

a character size table 19 in which the number of longitudinal dots (T1d, T2d, T3d . . . Tid) and the number of lateral dots (Y1d, Y2d, Y3d . . . Yid) corresponding to each of a plurality of character sizes (S1, S2, S3 . . . Si) are stored as shown in FIG. 4, and the like. Note, in the character size table 19, the character size S1 represents the maximum character size which is used when characters are printed on one line of the tape 5 having the maximum print width of 24 mm, and the character size Si represents the minimum character size which can be printed by the printing device. Further, data "Er" represents error data.

The CGROM (as a pattern data memory) 31 stores dot pattern data corresponding to each of the plurality of character sizes (S1, S2, S3 . . . Si) with respect to respective characters/symbols.

Figure 5:
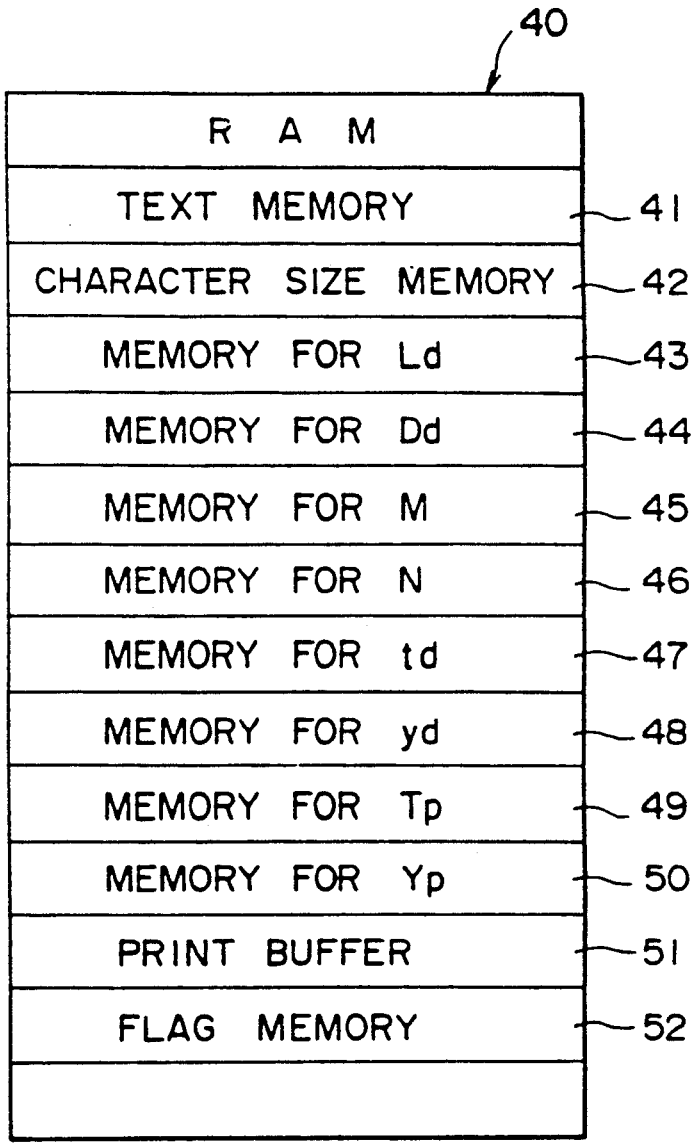
FIG. 5 is a table explaining memories provided with a RAM.

As shown in FIG. 5, in the RAM 40, provided are:

the text memory 41 for storing an input text data;

a character size memory 42 for storing any of the character sizes (S1, S2, S3 . . . Si) which has been set or determined based upon a calculation and used for a print processing;

a memory 43 for the number of dots over a print length which stores the number of dots Ld corresponding to a set print length;

a memory 44 for the number of dots over a tape width which stores the number of dots Dd corresponding to the tape width of the print tape 5 in the loaded tape accommodation cassette CS;

a memory 45 which stores the number of lines M of text data;

a memory 46 which stores the number of maximum characters N of the characters included in the respective lines of text data;

a memory 47 which stores the number of longitudinal dots (td) determined based on a calculation;

a memory 48 which stores the number of lateral dots (yd) determined based on a calculation;

a longitudinal pointer 49 which stores the item number of any item of the number of dots of the number of longitudinal dots (T1d, T2d, T3d . . . Tid);

a lateral pointer 50 which stores the item number of any item of the number of lateral dots (Y1d, Y2d, Y3d . . . Yid);

the print buffer 51 having a large capacity which is capable of storing 128 bits (16 bytes) of data corresponding to 128 dots in a longitudinal direction (dot train direction), and dot pattern data for a plurality of characters in a lateral direction and stores the dot pattern data of characters to be printed at a disposal position read and indicated from the CGROM 31; and a flag memory 52 stores an automatic size mode flag AF to be set when a character size is determined in automatically.

Figure 6:
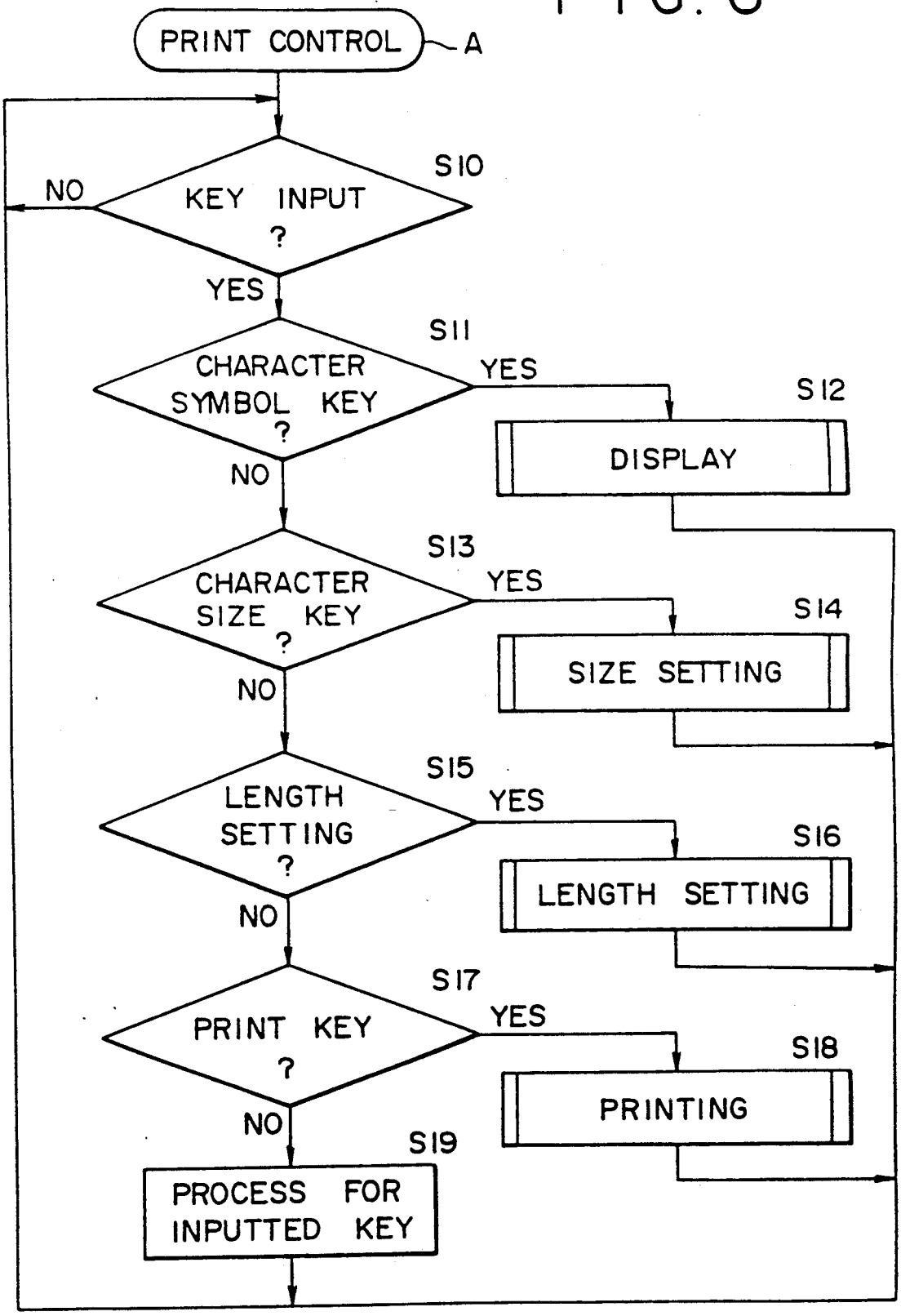
FIG. 6 is a flowchart of a tape print control routine.
Figure 7:
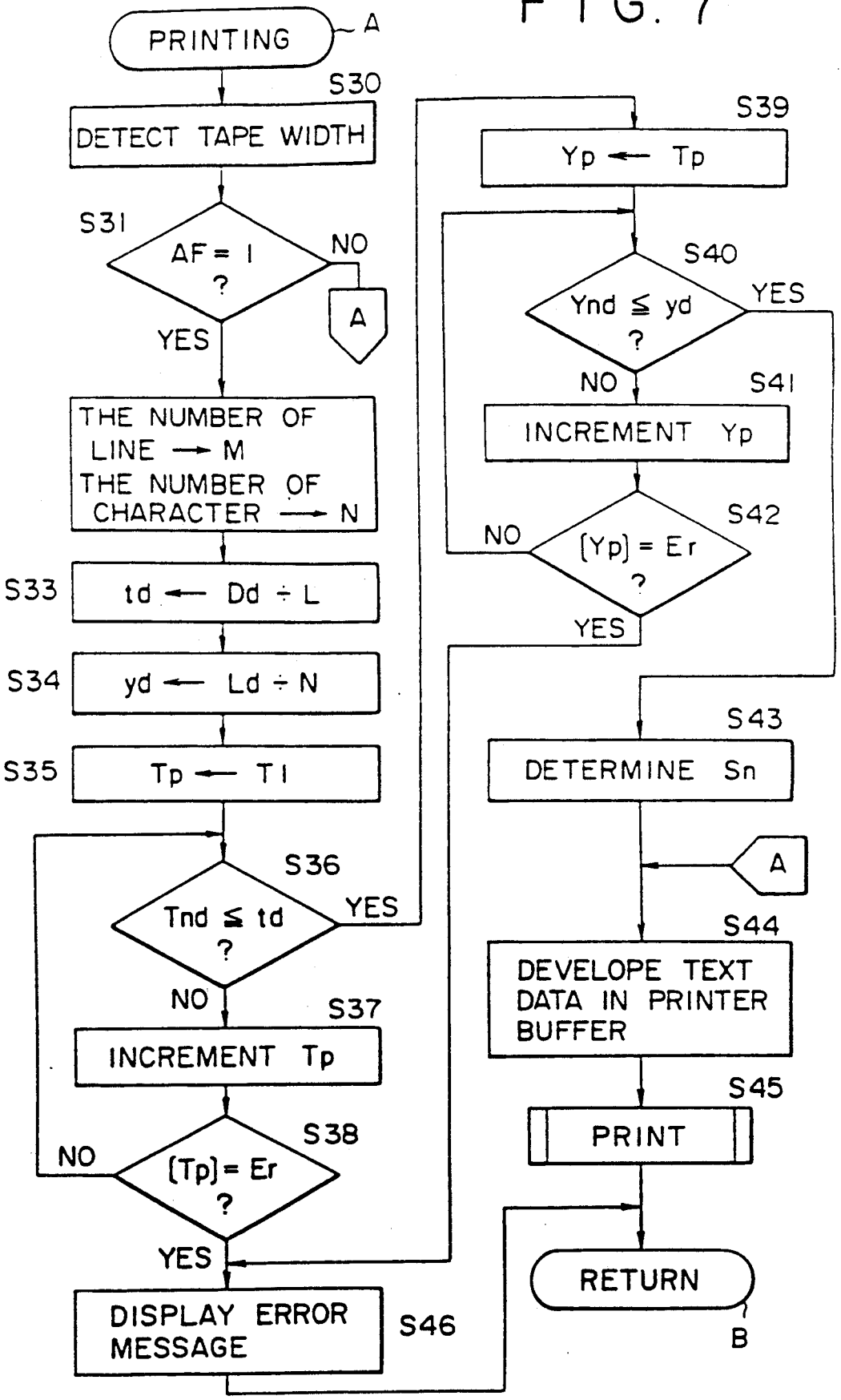
FIG. 7 is a flowchart of a print process control routine.

Next, a tape print control routine carried out by the control unit C of the printing device 1 will be described with reference to the flowcharts of FIGS. 6 and 7, wherein numerals i (i=10, 11, 12 . . . ) prefixed with "S" indicate the numbers of steps of the process.

When a power supply is turned ON, this control is started. When the character key, symbol key, numeral key and the like are operated (S10:Yes; S11:Yes), a data inputting process is executed to store inputted code data in the text memory 41 as a text data. Further, a display process for displaying characters corresponding to the code data on the display unit 22 is executed (S12). If the character size key is operated (S10:Yes; S11:No; S13:Yes), a character size setting process is executed (S14). More specifically, in this setting process, first, a character size information indicating the size most often used is displayed on the display unit 22, and further four other kinds of character sizes frequently used are sequentially displayed by operating the cursor movement key, and finally the "automatic size" is displayed. A character size can be set by operating a return key when a desired character size is displayed. Note, when the "automatic size" is set as a character size, the automatic size mode flag AF is set.

When the print length key is operated (S10:Yes; S11:No; S13:No; S15:Yes), a print length setting process is executed (S16). In this length setting process, first, "print length: 50 mm" is displayed, then "print length: 51 mm", print length: 52 mm", "print length: 53 mm" . . . up to "print length: 300 mm" are sequentially displayed with a pitch of 1 mm upon operating the cursor movement key. Therefore, a print length can be set by operating the return key in the state that a desired print length is displayed.

When the print key is operated (S10:Yes; S11:Yes; S13:Yes; S15:No; S17:Yes), a printing process (refer to FIG. 7) is executed (S18). When this control is started, first, the width of the tape of the loaded accommodation cassette CS is detected based on signals from the first and second sensors 20, 21, and further the dot number Dd corresponding to the tape width is determined and stored in the memory 44 (S30). Next, if the "automatic size" has been selected and thus the automatic size mode flag AF has been set (S31:Yes), the text data in the text memory 41 is searched, the number of lines M of the text data is stored in the memory 45, and the number of maximum characters N of the characters included in the respective lines is stored in the memory 46 (S32).

Next, the number of longitudinal dots td of characters to be printed on each line is determined by dividing the tape width Dd by the number of lines L (S33), and further the number of lateral dots yd of the characters to be printed is determined by dividing the print length Ld by the maximum number of characters N (S34). Next, in the character size table 19, the item T1 indicating the first row of the number of longitudinal dots is set to the longitudinal pointer Tp (S35). If the number of longitudinal dots Tnd indicated by the longitudinal pointer Tp is greater than the number of longitudinal dots td determined base on the calculation (S36:No), the longitudinal dots Tp is incremented by 1 (S37). If the longitudinal dots Tnd indicated by the longitudinal pointer Tp is not equal to the error data Er (S38:No), the steps S36 through S38 are repeated. Note that if the character size is too small, the printed character/symbol is difficult to read, or the quality of printed characters/symbols becomes quite low. For avoiding this problem, in the present embodiment, it is examined whether the number of dots is greater than a predetermined value, i.e., Er. If the number of longitudinal dots Tnd indicated by the longitudinal pointer Tp is equal to or less than the number of longitudinal dots td (S36: Yes), the value of the longitudinal pointer Tp is set to the lateral pointer Yp (S39). For example, as shown in FIG. 4, when the longitudinal pointer Tp indicates the fifth row of the table 19 in FIG. 4, in this case "5" has been set to the longitudinal pointer Tp, "5" is set to the lateral pointer Yp which indicates the row of the lateral dots in the table 19.

Next, when the number of the lateral dots Ynd indicated by the lateral pointer Yp is greater than the number of lateral dots yd determined by the calculation (S40:No), the lateral pointer Yp is incremented by 1 (S41). If the number of dots indicated by the lateral pointer Yp is not error data Er (S42:No), the steps S40 through S42 are repeated. If the number of lateral dots Ynd indicated by the lateral pointer Yp is equal to or less than the number of lateral dots yd (S42:Yes), a character size Sn corresponding to the number of lateral dots indicated by the lateral pointer Yp is determined as a printing character size and stored in the character size memory 42.

Figure 8:
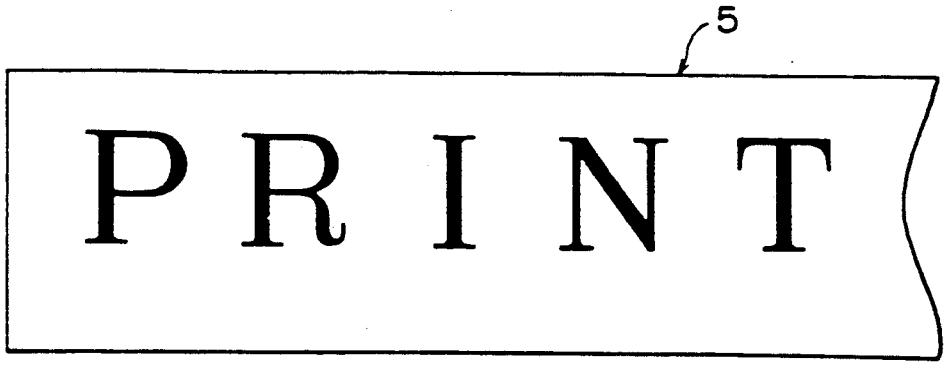
FIG. 8 shows an example of a printed tape, when characters are printed on one line of a print tape having a tape width of 24 mm.
Figure 9:
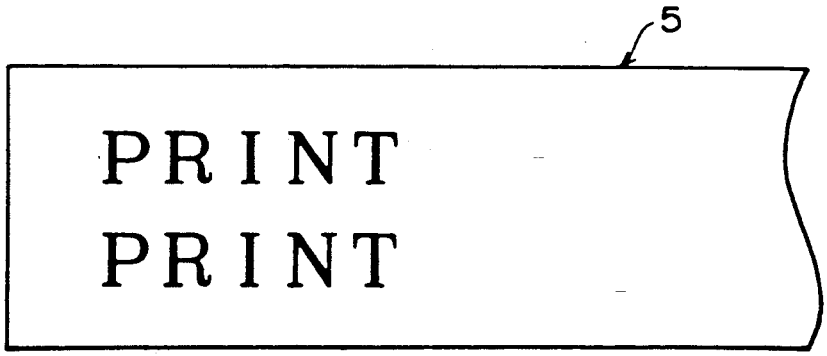
FIG. 9 shows an example of a printed tape when characters are printed on two lines of a similar print tape.
Figure 10:
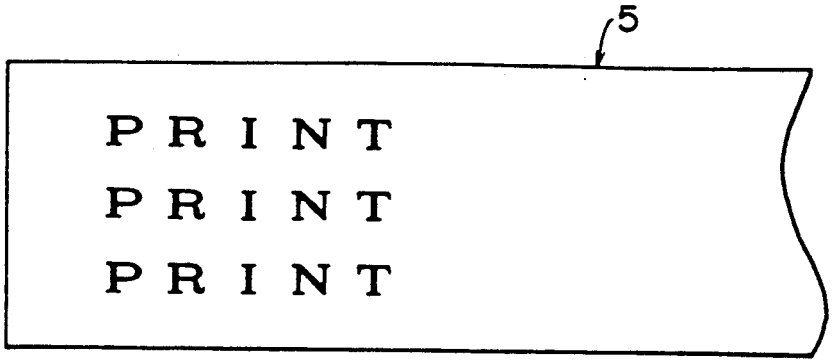
FIG. 10 shows an example of the printed tape when characters are printed on three lines of a similar print tape.
Figure 11:
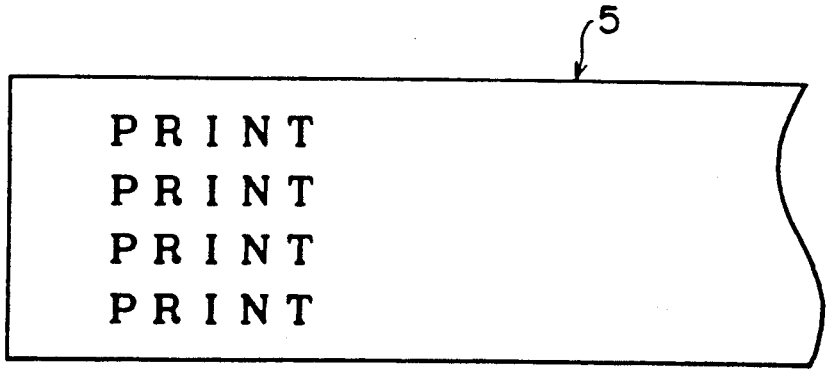
FIG. 11 shows an example of the printed tape when characters are printed on four lines of a similar print tape.

Next, the text data is developed to dot pattern data by using the dot pattern corresponding to the determined character size Sn in the print buffer 51 (S44), and a print processing is executed onto the tape 5 with use of the thermal head 13 based on the dot pattern data in the print buffer 51 (S45). Note, when the data indicated by the longitudinal pointer Tp is "Er" (S38:Yes) and when the data indicated by the lateral pointer Yp is "Er" (S42:Yes), an error message is displayed on the display unit 22 (S46), and the control is completed without performing printing operation. When the automatic size mode flag AF is reset (S31:No), the print processing is executed by using a set character size (S44, S45). For example, when characters are to be printed onto the tape 5 having a tape width of 24 mm on one line as shown in FIG. 8, the characters are printed at substantially the maximum character size based on the number of line "1" and tape width "24". Further, as shown in FIG. 9, when the characters are to be printed on two lines, they are printed by a character size suitable for a print on the two lines based on the number of lines "2" and tape width "24". In the same way, when the characters are to be printed on three lines, they are printed by a character size suitable for a print on the three lines (refer to FIG. 10), and when the characters are to be printed on four lines, they are printed by a character size suitable for a print on the four lines (refer to FIG. 11).

As described above, since a character size to be printed is determined in accordance with the tape width of the tape 5 used as a print medium, the number of lines of input characters and a print length, an optimum character size based on these print conditions can be automatically determined.

It should be noted that each dot pattern data includes the blank space between characters and lines, thereby printed characters/symbols are optimumly spaced with respect to each other.

Note, the width of the tape in the loaded tape accommodation cassette CS may be set by inputting through the keyboard 3 and the thus the set tape width may be used for the above tape print control. Further, a character size may be determined only by the number of print lines and a tape width in the above tape print control.

What is claimed is:

1. A printing device for printing characters/symbols on a tape member having a predetermined width, comprising:

means for inputting a length of said tape member within which said characters/symbols are printed;

first detecting means for detecting the number of said characters/symbols to be printed in a line within said length of said tape member;

second detecting means for detecting the number of lines to be printed within said predetermined width;

means for determining the size of the characters/symbols based upon:

the number of said characters/symbols detected by said first detecting means; and the number of lines detected by said second detecting means.

2. The printing device according to claim 1, wherein said determining means determines said size of the characters/symbols to be printed in such a fashion that said determining means determines a first size based upon said number of said characters/symbols, and a second size based upon said number of lines of said characters/symbols, and thereafter said determining means selecting a smaller one of said first and second sizes as said size of the characters/symbols to be printed.

3. The printing device according to claim 2, wherein said determining means determines said first size in accordance with the dividing operation in which the number of dots capable of being included in a line within said length is divided by the number of the characters/symbols to be printed within said length of said tape member.

4. The printing device according to claim 2, wherein said determining means determines said second size in accordance with the dividing operation in which the number of dots capable of being included in said predetermined width is divided by said number of lines of said characters/symbols to be printed within said predetermined width.

5. The printing device according to claim 4, which further comprises memory means for storing dot data corresponding to a plurality of sizes of said characters/symbols, and wherein said determining means selects one of said plurality of sizes as said size of characters/symbols to be printed.

6. The printing device according to claim 1, further comprising means for inhibiting printing operation when said size determined by said determining means is smaller than a predetermined size 7. A printing device for printing characters/symbols on a tape member, comprising:

means for printing in a plurality of sizes on said tape member;

means for detecting the number of said characters/symbols to be printed within a predetermined area; and means for determining one of said plurality of sizes for the characters/symbols to be printed based upon said number of said characters/symbols in accordance with a dividing operation in which the number of dots capable of being included in a line within said predetermined area is divided by the number of the characters/symbols to be printed within said predetermined area.

8. The printing device according to claim 7, further comprising means for setting said predetermined area within which said characters/symbols are printed.

9. The printing device according to claim 7, which further comprises memory means for storing dot data corresponding to a plurality of sizes of said characters/- symbols, and wherein said determining means selects one of said plurality of sizes as said size of characters/-symbols to be printed.

10. The printing device according to claim 7, further comprising means for inhibiting said printing operation when said size determined by said determining means is smaller than a predetermined size.

11. A printing device for printing characters/symbols in a tape member having a predetermined width, comprising:

means for detecting the number of lines to be printed within said predetermined width; and means for determining the size of the characters/symbols to be printed based upon said number of lines of said characters/symbols in accordance with a dividing operation in which the number of dots capable of being included in said predetermined width is divided by said character/symbols to be printed within said predetermined width.

12. The printing device according to claim 11, which further comprises memory means for storing dot data corresponding to a plurality of sizes of said characters/-symbols, and wherein said determining means selects one of said plurality of sizes as said size of characters/-symbols to be printed.

13. The printing device according to claim 11, further comprising means for inhibiting printing operation when said size determined by said determining means is smaller than a predetermined size.

14. A combination of a printer for printing characters/symbols on a tape member and a cassette detachably coupled to said printer for accommodating said tape member therein, wherein said cassette comprises:

means for indicating the width of said tape accommodated therein, and wherein said printer comprises:

means for detecting the number of lines to be printed; and means for determining the size of said characters/-symbols to be printed based upon said number of lines of said characters/symbols.

15. The combination according to claim 14, wherein said cassette comprises a case member, and wherein said indicating means has at least one projection on said case member for indicating that the width of the tape accommodated in said cassette is a first predetermined width, while no projection is provided when the width of the tape accommodated in said cassette is a second predetermined width.

16. The combination according to claim 15, wherein said printer comprises at least one sensor means for detecting, when said cassette is coupled to said printer, the existance of said at least one projection, whereby it is detected that said tape has said first width when the existance of said projection is detected, while it is detected that said tape has said second width when the existance of said projection is not detected.

17. The combination according to claim 14, which further comprises means for inputting a length of said tape, the characters/symbols being printed within said length at each printing operation, and wherein said determining means determines said size of said characters/symbols to be printed based upon the number of characters/symbols to be printed within said length as well as said number of lines.

18. The combination according to claim 17, wherein said determining means determines said size of the characters/symbols to be printed in such a fashion that said determining means determines a first size based upon said number of said characters/symbols, and a second size based upon said number of lines of said characters/-symbols, and thereafter said determining means selecting a smaller one of said first and second sizes as said size of the characters/symbols to be printed.

19. The combination according to claim 18, wherein said determining means determines said first size in accordance with the dividing operation in which the number of dots capable of being included in a line within said length is divided by the number of the characters/symbols to be printed within said length of said tape member.

20. The combination according to claim 18, wherein said determining means determines said second size in accordance with the dividing operation in which the number of dots capable of being included in said predetermined width is divided by said number of lines of said characters/symbols to be printed within said predetermined width.

21. The combination according to claim 17, which further comprises memory means for storing dot data corresponding to a plurality of sizes of said characters/-symbols, and wherein said determining means selects one of said plurality of sizes as said size of characters/-symbols to be printed.

22. The combination according to claim 17, further comprising means for inhibiting printing operation when said size determined by said determining means is smaller than a predetermined size.

* * * * *